US007909523B2

(12) United States Patent
Sakano

(10) Patent No.: US 7,909,523 B2
(45) **Date of Patent: *Mar. 22, 2011**

(54) SHEET BUNDLE PRINTER AND METHOD OF CONTROLLING SHEET BUNDLE PRINTER

(75) Inventor: Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 704 days.

This patent is subject to a terminal disclaimer.

(21) Appl. No.: 11/849,883

(22) Filed: Sep. 4, 2007

(65) Prior Publication Data

US 2008/0063457 A1 Mar. 13, 2008

(30) Foreign Application Priority Data

Sep. 11, 2006 (JP) ..... 2006-245692

(51) Int. Cl.

| | |
|---|---|
| ***B41J 13/00*** | (2006.01) |
| ***B41J 11/04*** | (2006.01) |
| ***B41J 29/00*** | (2006.01) |
| ***B65H 3/06*** | (2006.01) |

(52) U.S. Cl. ..... 400/628; 400/624; 400/629; 400/649; 347/218; 271/21; 271/42

(58) Field of Classification Search ..... 400/624, 400/628, 629, 649; 347/218; 271/16, 10.14, 271/19, 21, 42

See application file for complete search history.

(56) References Cited

U.S. PATENT DOCUMENTS

| | | | | |
|---|---|---|---|---|
| 3,425,685 | A * | 2/1969 | Liva | 271/21 |
| 4,431,176 | A * | 2/1984 | Deconinck | 271/22 |
| 4,981,235 | A * | 1/1991 | Ferrini et al. | 221/23 |
| 5,695,291 | A * | 12/1997 | Park | 400/120.16 |
| 6,702,274 | B1 | 3/2004 | Otsuka | |
| 6,715,750 | B1 * | 4/2004 | Gerlier et al. | 271/21 |
| 6,978,992 | B2 | 12/2005 | Otsuka | |
| 7,393,075 | B2 | 7/2008 | Horiuchi | |

FOREIGN PATENT DOCUMENTS

| | | | |
|---|---|---|---|
| JP | 2001039552 | A | 2/2001 |
| JP | 2002052760 | A * | 2/2002 |
| JP | 2002283637 | A | 10/2002 |
| JP | 2003081457 | A * | 3/2003 |
| JP | 2003212367 | A * | 7/2003 |
| JP | 2005096450 | A | 4/2005 |
| JP | 2006160475 | A * | 6/2006 |

* cited by examiner

*Primary Examiner* — Daniel J Colilla
(74) *Attorney, Agent, or Firm* — DLA Piper LLP (US)

(57) ABSTRACT

A sheet bundle printer includes a platen roller facing a sheet bundle having peelably adhered multiple sheets of sheet and pulling up an uppermost sheet thereof, a print head feeding the sheet and performing printing thereon while peeling it off with the platen roller, a platen moving device reciprocally moving the platen roller between a pull up position and a print position, and a control device controlling the platen roller, the platen moving device and the print head, and executing a print processing operation including operations of pull up, platen upward movement, print and feed, and platen downward movement. The control device sets a state where the platen roller is located at a predetermined intermediate position in a path from the pull up position to a non-contact position immediately before the print position, to an operation start position of the print processing operation and executes the operation from that position.

3 Claims, 5 Drawing Sheets

SHEET BUNDLE PRINTER AND METHOD OF CONTROLLING SHEET BUNDLE PRINTER

The entire disclosure of Japanese Patent Application No. 2006-245692, filed Sep. 11, 2006, is expressly incorporated by reference herein.

BACKGROUND

1. Technical Field

The present invention relates to a sheet bundle printing system for printing on a piece of sheet (hereinafter simply referred to as "a sheet") to be peeled off out of a sheet bundle such as a sticky note bundle (i.e., a bundle of sticky notes temporarily held together by partially and removably adhering them together for use by peeling off one by one) and the like, and also relates to a sheet bundle printer.

2. Related Art

In the known art, there is a sticky note printer (a sheet bundle printer) of this type, which sets a print stand-by state to a state where a platen roller is in contact with an uppermost sticky note of a sticky note bundle set therein, which is, for example, described in Japanese Unexamined Patent Application Publication No. 2003-212367. This sticky note printer, once a print key is pressed, pulls up an uppermost sticky note with the platen roller and then moves the pulled-up sticky note so as to be pinched between the platen roller and the print head, and performs printing with the print head while the platen roller feeds the pinched sticky note toward a sheet ejecting slot. Thereafter, a user takes away the printed sticky note placed at the sheet ejecting slot, thus making it possible to obtain the sticky note on which a desired image is printed.

Meanwhile, a sticky note may possibly be used as memo pad. In light of that application, the sticky note printer is preferably configured to place a sticky note at the sheet ejecting slot as quickly as possible in order to immediately provide the sticky note for a user when the user needs a sticky note, that is, when the user instructs the printer to provide a sticky note. However, the above known sticky note printer starts a print processing operation at a timing when the sticky note is pulled up, so that it takes a long time for the sticky note to be placed at the sheet ejecting slot. Accordingly, it is inconvenient for a user to use the sticky note printer.

SUMMARY

An advantage of some aspects of the invention is that it provides a sheet bundle printer and method of controlling a sheet bundle printer that are capable of reducing the amount of time taken until a sheet is placed at a sheet ejecting slot.

A first aspect of the invention provides a sheet bundle printer. The sheet bundle printer includes a platen roller, a print head, a platen moving device, and a control device. The platen roller faces a sheet bundle made up of a multiplicity of sheets releasably adhered together at one end respectively, and pulls up an uppermost sheet out of the sheet bundle. The print head feeds the sheet toward a sheet ejecting slot while peeling off the sheet in cooperation with the platen roller, and performs printing on the sheet which is being fed. The platen moving device reciprocally moves the platen roller between a pull up position where the platen roller faces the uppermost sheet and a print position where the platen roller contacts the print head. The control device controls the platen roller, the platen moving device and the print head. The control device executes a print processing operation that includes a pull up operation in which the sheet is pulled up, a platen upward movement operation in which the platen roller is moved from the pull up position to the print position, a print and feed operation that synchronizes feeding of the sheet to the sheet ejecting slot with driving of the print head, and a platen downward movement operation in which the platen roller is moved from the print position to the pull up position. The control device sets a state where the platen roller is located at a predetermined intermediate position which is located in a path from the pull up position to a non-contact position that is immediately before the print position, to an operation start position of the print processing operation. The control device executes the print processing operation from the operation start position.

A second aspect of the invention provides a method of controlling a sheet bundle printer. The method includes: pulling up an uppermost sheet out of a sheet bundle by means of a platen roller when the platen roller is located at a pull up position where the platen roller faces the uppermost sheet out of the sheet bundle made up of a multiplicity of sheets releasably adhered together at one end respectively; moving the platen roller from the pull up position to a print position where the platen roller contacts the print head, and pinching the pulled up sheet between a print head and the platen roller; feeding the pinched sheet toward a sheet ejecting slot while peeling off the sheet by means of the platen roller, and performing printing on the sheet, while being fed, by means of the print head; moving the platen roller from the print position to the pull up position after the print and feed operation is completed; setting a state where the platen roller is located at a predetermined intermediate position which is located in a path from the pull up position to a non-contact position that is immediately before the print position, to an operation start position of the print processing operation; and executing the print processing operation from the operation start position.

According to the above configuration, because the operation start position is set at the intermediate position, a state where the uppermost sheet is pulled up by the platen roller becomes a print standby state. That is, a pull up operation of the sheet is executed in advance before the print processing operation. Therefore, as a print command is issued, the platen roller performs a platen upward movement operation from the intermediate position and then moves onto a print and feed operation. Then, after the sheet is fed toward the sheet ejecting slot by the print and feed operation, a platen downward movement operation is executed. Thereafter, the pull up operation is executed, and the platen roller is moved to the start operation position again (intermediate position) by the platen upward movement operation, thus ending a sequence of print processing operation. In this manner, the period of time from the start of print processing operation to the time when the sheet is placed at the sheet ejecting slot, that is, the amount of time taken for the pull up operation and the platen upward movement operation executed until the platen roller reaches the intermediate position, may be reduced, so that it is possible to place the sheet at the sheet ejecting slot further quickly. Note that the sheet bundle includes a sticky note bundle, a memo pad, and the like.

In this case, the sheet bundle printer may further include a detection device that detects presence or absence of the sheet that is pulled up by the platen roller at the start operation position, and an annunciation device that announces that the sheet is not pulled up by the platen roller when the detection device has detected absence of the sheet before the print processing operation is executed.

According to this configuration, when the sheet is not pulled up by the platen roller at the start operation position due to replacement of the sheet bundle, failure to pull up, or the like, it is possible to announce a user of this situation.

In this case, the sheet bundle printer may further include a sheet bundle printer body and a computer. The sheet bundle printer body includes the platen roller, the platen moving device, the print head, and the detection device. The computer includes the control device and the annunciation device.

According to this configuration, by controlling the sheet bundle printer body using the computer, it is possible to set the start operation position to the intermediate position of the platen roller within the platen upward movement operation and it is possible to reduce the amount of time taken until the sheet is placed at the sheet ejecting slot.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a sticky note printer in which a sheet bundle printer according to the invention is applied will be described with reference to the accompanying drawings. The sticky note printer, on the basis of print data edited with a personal computer, using a sticky note printer body, pulls up an uppermost sticky note out of a sticky note bundle (a sheet bundle) that is set in the sticky note printer body, and performs printing while peeling off the sticky note that has been pulled up, and then ejects the printed sticky note to outside the system.

Figure 1:
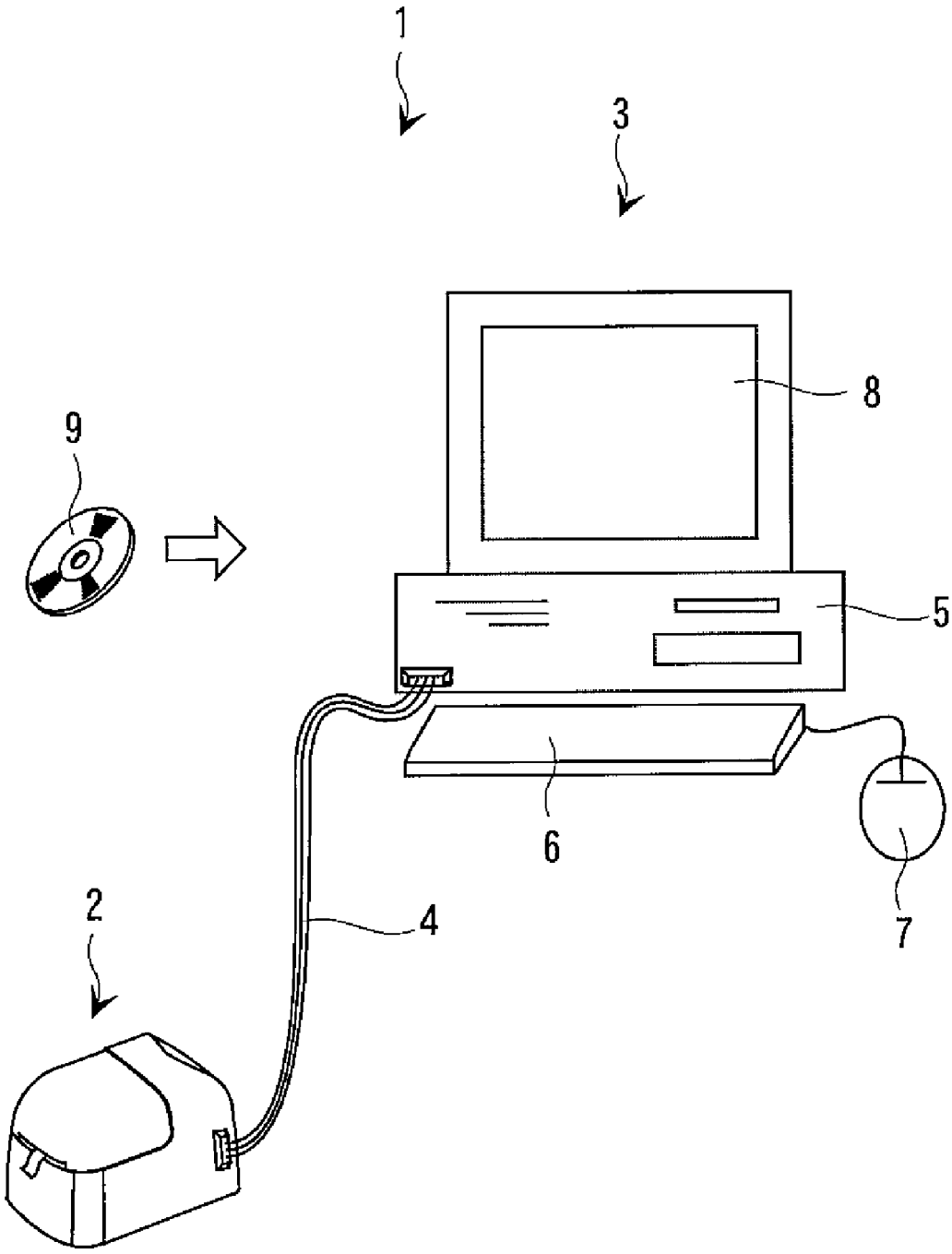
FIG. 1 is a schematic view of a sticky note printer according to an embodiment of the invention.

As shown in FIG. 1, the sticky note printer 1 includes a sticky note printer body 2 and a personal computer (control unit) 3. A sticky note bundle H is set in the sticky note printer body 2. The personal computer 3 is connected to the sticky note printer body 2 through a USB cable 4, or the like. The personal computer 3 creates and/or edits print data for printing on a sticky note H1 and controls driving of various portions of the sticky note printer body 2.

The personal computer 3 includes a personal computer body 5, a keyboard 6, a mouse 7, and a display 8, which are connected to the personal computer body 5. The keyboard 6 and the mouse 7 are used for inputting data. The display 8 displays input results, or the like. The personal computer body 5 has set application software (program) relating to the sticky note printer body 2 and also has detachably sets a CD-ROM 9 in which data, such as a device driver, is stored. When various detection signals, various commands, various data, or the like, are input using the keyboard 6, or the like, the personal computer 3, in accordance with a program stored in the CD-ROM 9, processes such various data and then controls the sticky note printer body 2. Although the details will be described later, the display 8 is configured to serve as an annunciation unit that outputs an alarm, or the like, on the basis of the result detected by a detection sensor 23 which is provided inside the sticky note printer body 2, by means of image display, sound, or the like.

Needless to say, it is also applicable that the stand-alone sticky note printer body 2, which is provided with a function of creating and/or editing print data and a function of controlling the portions of the printer, performs printing on the sticky note H1.

Figure 2:
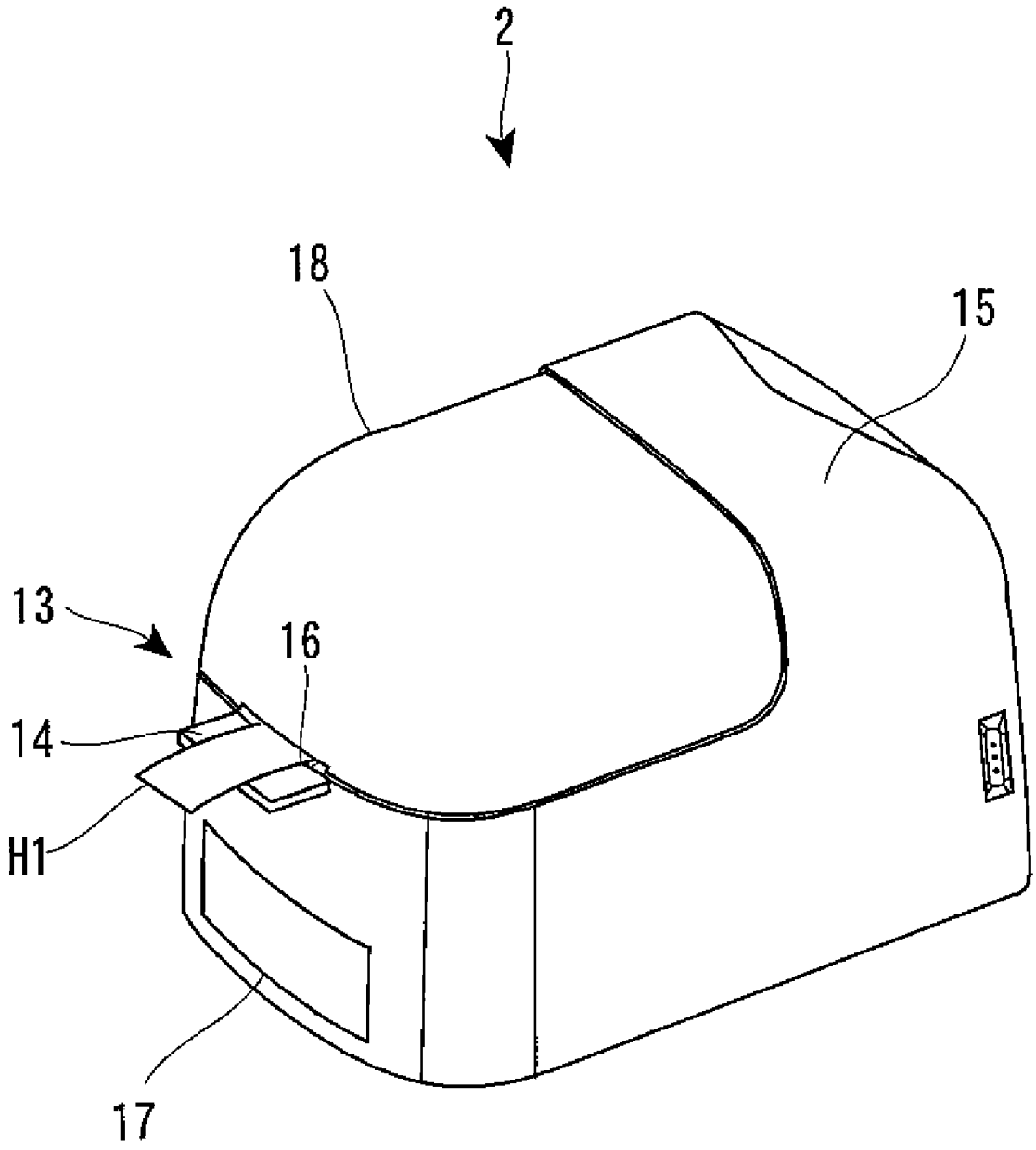
FIG. 2 is a perspective view of a sticky note printer body according to the embodiment.

As shown in FIG. 2, the sticky note printer body 2 has a printer case 15, forming an outer case, and a sticky note bundle H is set inside the printer case 15. The sticky note printer body 2 prints desired lines of characters, created with the personal computer 3, onto the sticky note H1 that has been peeled off from the set sticky note bundle H, and then ejects the printed sticky note H1 through a sheet ejecting portion 13 formed in the printer case 15.

The size of the printer case 15 is small as a whole. A sticky note setting opening 17 is formed in the front lower portion of the printer case 15 and is used for setting a pullout sticky note holder 20, which will be described later, into the case from the front. The sheet ejecting portion 13 is provided in the upper and front middle portion of the printer. The sheet ejecting portion 13 has a horizontal slit-like sheet ejecting slot 16 that ejects a printed sticky note H1 to outside the case and a receiving portion 14 that extends from the inside of the case via the sheet ejecting slot 16 to the outside of the case. The receiving portion 14 receives the pulled off and printed sticky note H1. In addition, a ribbon cartridge C that contains an ink ribbon R is installed on the upper surface of the printer case 15 and an openable cover 18 is provided on the upper surface of the printer case 15 for allowing maintenance.

Figure 3:
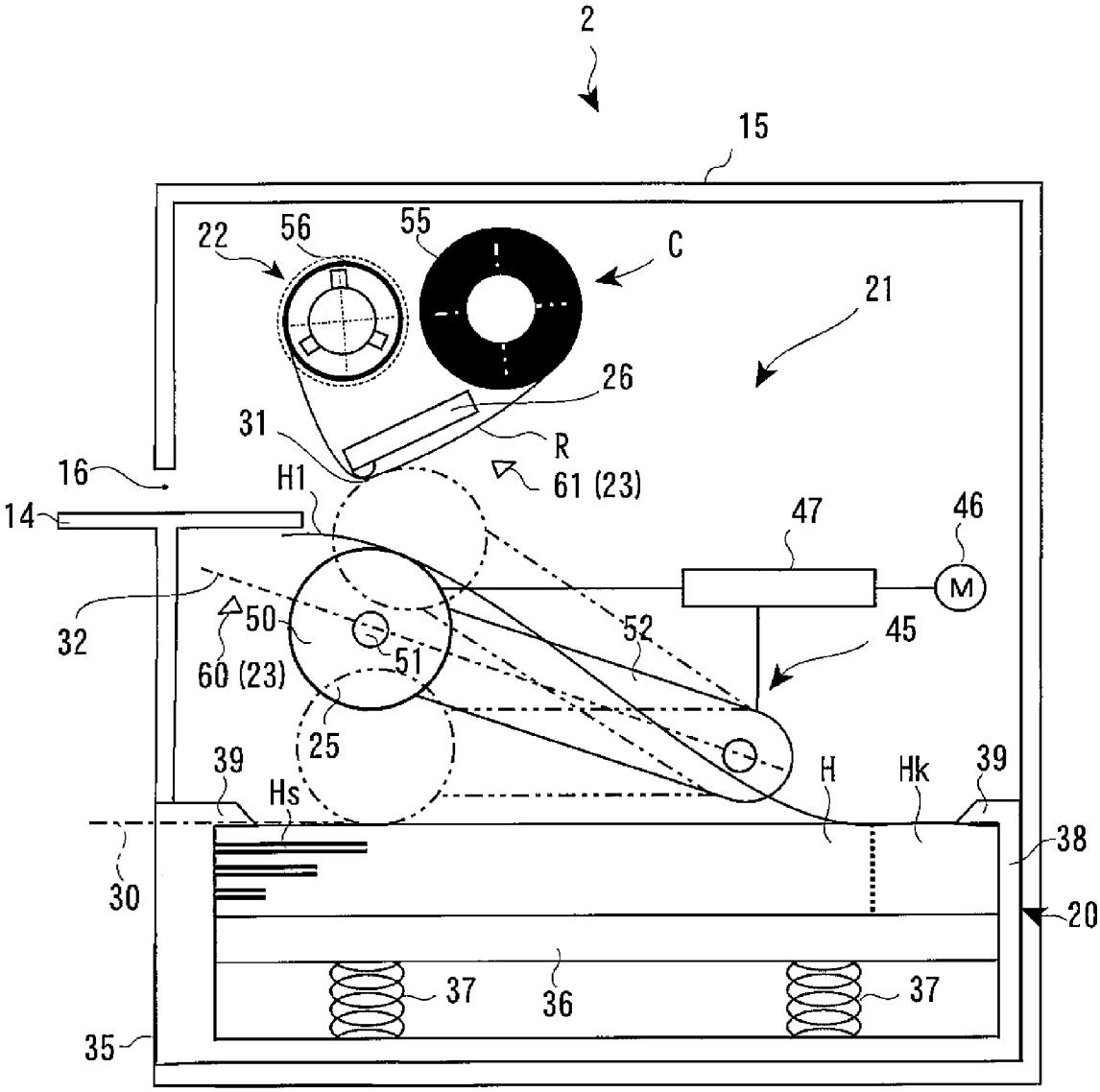
FIG. 3 is a schematic internal view of the sticky note printer body according to the embodiment.

As shown in FIG. 3, the sticky note bundle H is formed so that a plurality of rectangular sticky notes H1 are stacked by partially adhering the proximal ends Hk of the back faces of the sticky notes H1 to each other. The sticky notes H1 are peeled off from the sticky note bundle H sheet by sheet, and, after the peeling, are stuck on a handbook, or the like, by means of the adhesive portion of the proximal portion.

The sticky note printer body 2 includes the sticky note holder 20, a sticky note transport unit 21, and a printing unit 22. The sticky note bundle H is set in the sticky note holder 20. The sticky note transport unit 21 includes a platen roller 25 that, after pulling off an uppermost sticky note H1 out of the set sticky note bundle H at the pull up position 30, peels off the sticky note H1, and transports the sticky note H1 toward the sheet ejecting slot 16. The printing unit 22 includes a thermal head (print head) 26 and performs printing on the sticky note H1 that is transported in cooperation with the platen roller 25. These components are contained in the above printer case 15. In addition, the sticky note printer body 2 is provided with a detection sensor 23 that detects presence or absence of the sticky note H1 moving between the pull up position 30 and the print position 31 at an intermediate position 32, which will be described later. That is, the platen roller 25 serves not only as a feed roller of the sticky note transport unit 21 but also as a platen roller of the printing unit 22.

As shown in FIG. 3, the sticky note holder 20 includes a sticky note bundle case 35 and a mounting stage 36. The sticky note bundle case 35 is formed in a box shape with its top opened. The mounting stage 36 is contained in the sticky note bundle case 35 and mounts the sticky note bundle H horizontally. Four coil springs (two of them shown in the drawing) 37 are interposed between the mounting stage 36 and the bottom surface of the sticky note bundle case 35 and urge the mounting stage 36 upward. In addition, the sticky note holder 20 is provided so that it may be pulled out from the printer case 15 and is detachably mounted through the sticky note setting opening 17. Thus, when the sticky note bundle H is charged or replaced, the whole sticky note holder 20 is removed and the sticky note bundle H is then set.

The sticky note bundle case 35 includes a box-shaped case body 38 and a pair of position regulating portions 39, which are integrally formed with each other. The case body 38 slidably guides the mounting stage 36. The pair of position regulating portions 39 are provided at both upper ends of the case body 38 and project inward so as to hold the distal end Hs and proximal end Hk of the sticky note bundle H.

The mounting stage 36 is formed in a plate-like shape and is urged upward by the four coil springs 37. When the sticky note bundle H is set on the mounting stage 36, the pair of position regulating portions 39 maintain the level of the uppermost sticky note H1 at a constant height even when the sticky notes H1 are fed sheet by sheet and reduced in number. Then, a position where the sticky note bundle H is set becomes a pull up position 30 where the sticky note bundle H is pulled up by the sticky note transport unit 21.

When the sticky note bundle H is set onto the mounting stage 36 of the sticky note holder 20 through the upper opening of the sticky note bundle case 35, the sticky note bundle H is urged upward by the coil springs 37 and the distal end Hs and proximal end Hk of the sticky note bundle H are positioned at the pull up position 30 so that the pair of position regulating portions 39 maintain the sticky note bundle H being mounted horizontally.

The sticky note transport unit 21 is configured to pull up the uppermost sticky note H1 of the sticky note bundle H, located at the pull up position 30. The sticky note transport unit 21 includes the platen roller 25, a platen moving unit 45, a drive motor 46, and a reduction gear train 47. The platen roller 51 rolls on and contacts the uppermost sticky note H1, pulls up the note H1 and then peels off the pulled-up sticky note H1. The platen moving unit 45 moves the platen roller 51 in a range between the pull up position 30 and a print position 31 where the platen roller 25 contacts the thermal head 26. The drive motor 53 is a drive source of the platen roller 51 and the platen moving unit 45. The reduction gear train 47 transmits the driving force of the drive motor 46 to the platen roller 25 and the platen moving unit 45.

The platen roller 25 rolls on and contacts the back face of the distal end of pulled-up sticky note H1 and rotates to feed the sticky note H1 while peeling off the sticky note H1 at the print position 31. The platen roller 25 includes a roller body 50 and a roller drive shaft 51. The roller body 50 directly rolls on and contacts the sticky note H1. The roller drive shaft 51 serves as a rotary shaft of the roller body 50. The roller drive shaft 51 rotates with power of the drive motor 46 transmitted through the reduction gear train 47.

The platen moving unit 45 rotatably holds the roller drive shaft 51 at its distal end and includes a pair of pivot arms 52 that are provided pivotally (swingably) about their proximal ends. For example, the platen moving unit 45 has a planetary gear mechanism, which uses one of the pivot arm 52 as a carrier and part of gears forming the above reduction gear train 47, and a cam mechanism, which converts rotational force of the gears to the rotational movement of the pivot arm 52. That is, the circular motion performed by the planetary gear mechanism is converted to reciprocally pivotal movement of the pivot arm 52 by the cam mechanism. Owing to the reciprocally pivotal movement of this pivot arm 52, the platen roller 25 reciprocally moves between the pull up position 30 and the print position 31, that is, a platen upward movement operation in which the platen roller 25 is moved from the pull up position 30 to the print position 31 and a platen downward movement operation in which the platen roller 25 is moved from the print position 31 to the pull up position 30 are performed. In addition, the platen moving unit 45, at an initial state (print stand-by state), positions the platen roller 25 at an intermediate position 32 in a path between the pull up position 30 and the print position 31, and is configured to initiate a sequence of platen reciprocal movement with the intermediate position 32 set as a start operation position.

The printing unit 22 includes the thermal head 26 located adjacent to the sheet ejecting slot 16 and a ribbon take up mechanism (not shown) that takes up the ink ribbon R of the set ribbon cartridge C. The ribbon cartridge C includes a ribbon pay out reel 55, a ribbon take up reel 56, and a cartridge case (not shown). The ribbon pay out reel 55 winds the ink ribbon R so that the ink ribbon R may be paid out. The ribbon take up reel 56 takes up the ink ribbon R. The cartridge case rotatably contains these components. In addition, the ribbon take up mechanism, as the platen roller 25 is moved to the print position 31, is coupled to the reduction gear train 47 so as to be supplied with power input from the drive motor 46, and is configured to initiate taking up (feeding) of the ink ribbon R, following the feeding of the sticky note H1.

Thus configured printing unit 22 performs printing on the sticky note H1 while the thermal head 26 and the drive motor 46 are being controlled on the basis of control signals sent from the personal computer 3. That is, the sticky note H1 and the ink ribbon R are pinched between the platen roller 25, that has moved to the print position 31, and the thermal head 26, and, while these are being fed in the same direction, printing is performed on the surface of the sticky note H1 by the thermal head 26 being thermally driven on the basis of print data.

The detection sensor 23 is formed of optical sensors including a light receiving element 60 and a light emitting element 61. One of the elements is arranged below the receiving portion adjacent to the sheet ejecting slot 16, and the other element is arranged to the right side of the thermal head 26 in the drawing. That is, at the start operation position (the intermediate position 32), the detection sensor 23 is provided so as to place the distal end Hs of the pulled-up sticky note H1 in between in order to detect presence or absence of the sticky note H1 that is pulled up by the platen roller 25.

At the start operation position, when the detection sensor 23 detects absence of the sticky note, the detected result is input to the personal computer 3, and then displays an alert that indicates that the sticky note H1 is not pulled up by the platen roller 25 on the display 8 of the personal computer 3. In this manner, a user may be notified in advance that printing is performed without the sticky note H1. In addition, when the user views the alarm, the user performs a manual operation, such as pressing a predetermined key, to have the sticky note printer body 2 perform the pull up operation (for example, manipulate a reset key to perform the pull up operation) to have the platen roller 25 placed at the start operation position, so that the sticky note H1 is placed above the platen roller 25.

Here, a sequence of print processing operation for the sticky note H1 according to the present embodiment will be described with reference to FIGS. 4A to 4G, and the sequence of print processing operation is compared with a sequence of the existing print processing operation for the sticky note H1 with reference to FIG. 5. In a print standby state, the platen roller 25 is located at the intermediate position 32 and rolls on and contacts the back face of the sticky note H1 so that the uppermost sticky note H1 of the sticky note bundle H that is set in the sticky note holder 20 runs on the platen roller 25 (see FIG. 4A). Then, when the detection sensor 23 detects absence of the sticky note H1, an alarm that indicates that the sticky note H1 is not pulled up is displayed on the display 8.

Figures 4A, 4B, 4C, 4D, 4E, 4F, 4G:
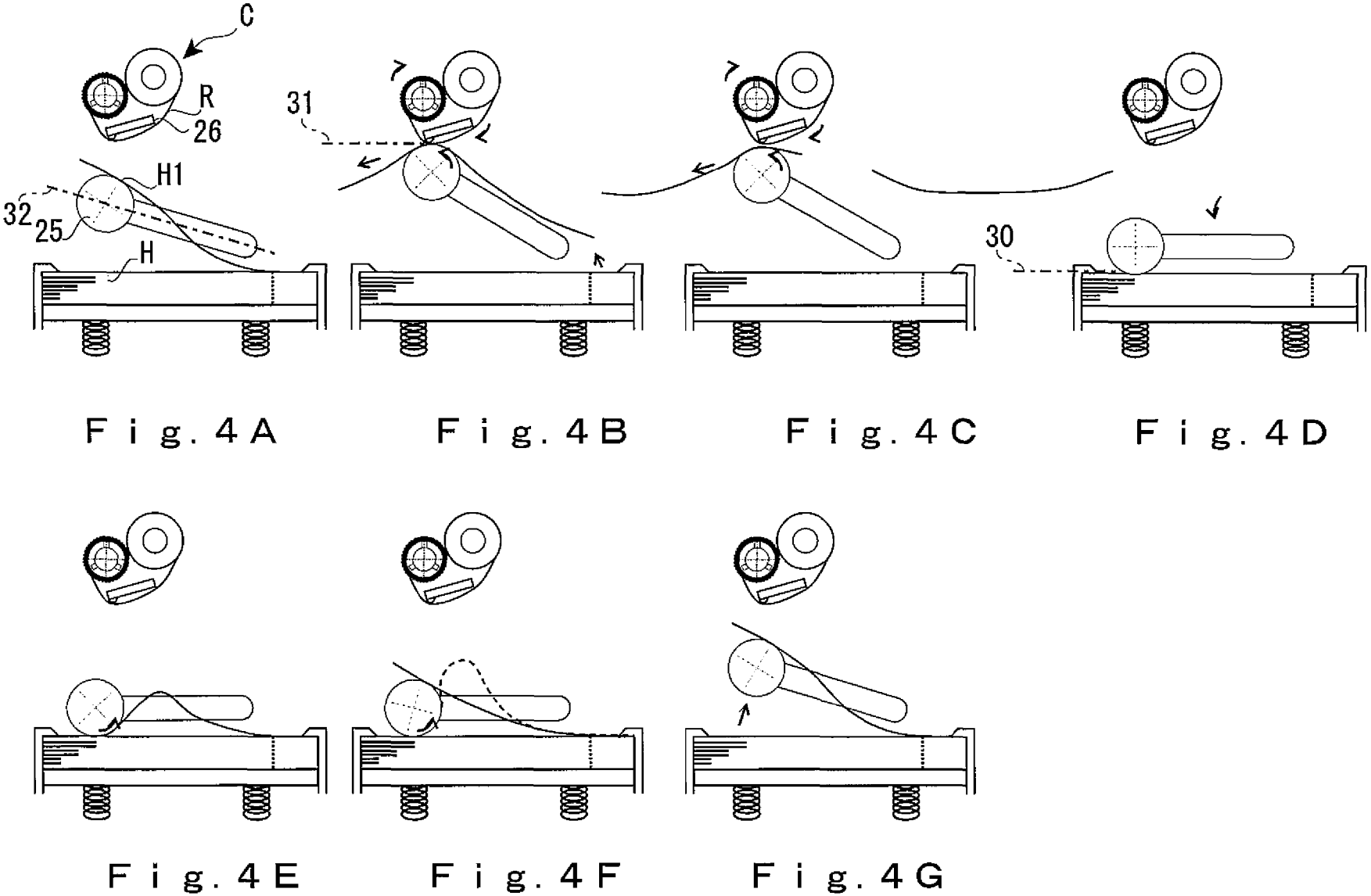
FIGS. 4A to 4G are views illustrating a sequence of print processing operation of the sticky note printer body.
Figure 5:
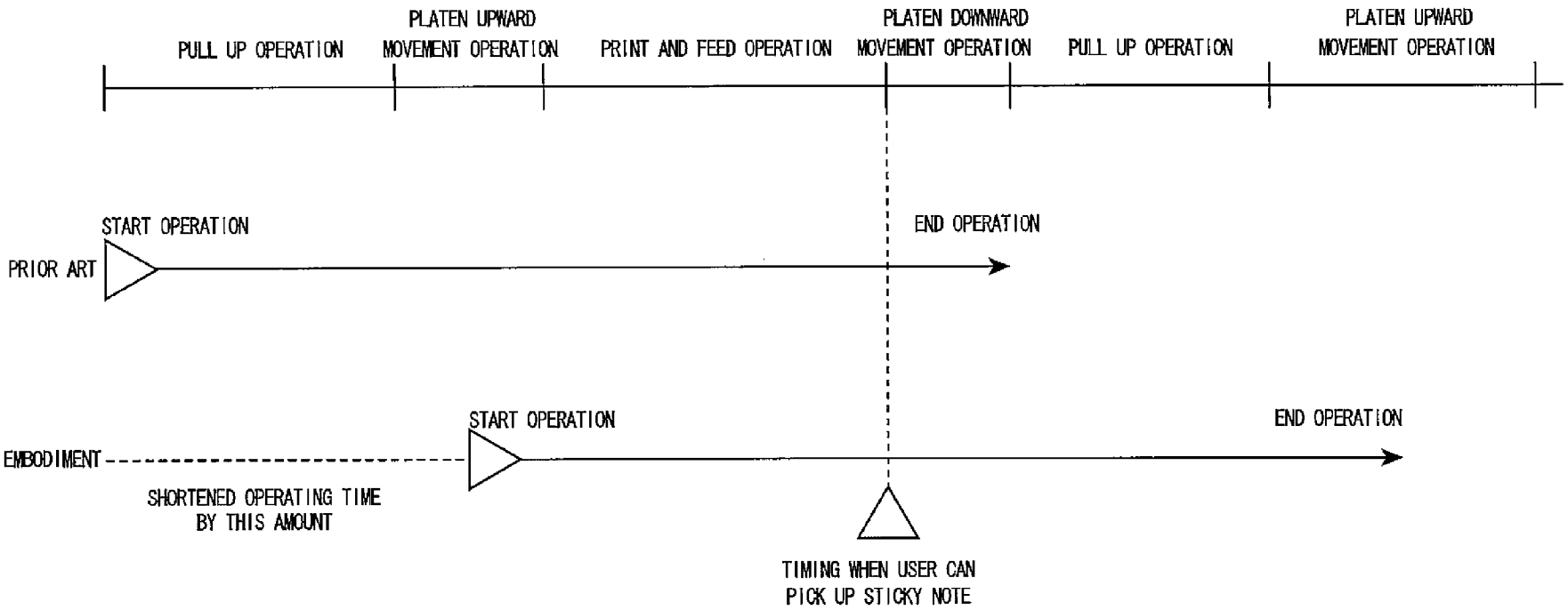
FIG. 5 is a chart view showing a comparison between the print processing operation of the sticky note printer body according to the embodiment and a print processing operation according to the known art.

When the personal computer 3 instructs to start printing in a state where presence of the sticky note H1 is detected by the detection sensor 23, the platen roller 25 starts a platen upward movement operation in which the platen roller 25 is moved (orbited) from the intermediate position 32 to the print position 31 while being rotated (self-rotated) (see FIG. 4B). When the platen roller 25 reaches the print position 31 and pinches the sticky note H1 with the thermal head 26, the feeding of the ink ribbon R is initiated in response to this (see FIG. 4B).

The platen roller 25, located at the print position 31, cooperates with the thermal head 26 to peel off the pinched sticky note H1 from the sticky note bundle H, and rotates to feed the sticky note H1, with the distal end side thereof preceding the proximal end side, toward the sheet ejecting slot 16 while initiating a print and feed operation in which printing is performed on the front face of the sticky note H1 from its distal end side (see FIG. 4B).

Then, as the adhesive portion of the sticky note H1 reaches the platen roller 25, the platen roller 25 initiates a platen downward movement operation in which the platen roller 25 is moved from the print position 31 to the pull up position 30. During a process of the movement, the printed sticky note H1 is handed to the receiving portion 14 (see FIG. 4C). At this point, the printed sticky note H1 that has been handed to the receiving portion 14 may be taken away by a user (see FIG. 4D).

Subsequently, the platen roller 25, located at the pull up position 30, initiates a pull up operation in which the platen roller 25 is rotated to pull up the uppermost sticky note H1 out of the sticky note bundle H. Then, as the platen roller 25 rolls on and contacts the distal end side of the front face of the uppermost sticky note H1, the middle portion of the sticky note H1 in the longitudinal direction is gradually bent upward to be curved (see FIG. 4E).

Immediately after the distal end of the sticky note H1, being pulled up, passes below the platen roller 25, the sticky note H1 is turned above the platen roller 25 owing to the rotation of the platen roller 25, and the distal end of the sticky note H1 runs onto the platen roller 25 (see FIG. 4F).

Thereafter, owing to the platen upward movement operation, the platen roller 25 is moved from the pull up position 30 to the intermediate position 32, thus ending a sequence of print processing operation (see FIG. 4G).

As described above, because the start operation position is set to the intermediate position 32, the print processing operation may be initiated in a state where the sticky note H1 is pulled up in advance. In this manner, as compared with the existing art (see FIG. 5), within the period of time from the start of print processing operation to the time when the sticky note H1 is placed at the sheet ejecting slot 16, the amount of time taken for the pull up operation and the platen upward movement operation executed until the platen roller 25 reaches the intermediate position 32 may be reduced, so that it is possible to place the sticky note H1 at the sheet ejecting slot 16 further quickly. Note that the sticky note bundle H is used as a sheet bundle in the present embodiment, but a memo pad may be used in place of the sticky note bundle H.

What is claimed is:

1. A sheet bundle printer comprising:

a platen roller that faces a sheet bundle made up of a multiplicity of sheets releasably adhered together at one end respectively, pulls up an uppermost sheet out of the sheet bundle, and feeds the sheet toward a sheet ejecting slot while peeling off the sheet;

a print head that performs printing on the sheet which is being fed;

a platen moving device that reciprocally moves the platen roller between a pull up position where the platen roller faces the uppermost sheet and a print position where the platen roller contacts the print head;

a control device that controls the platen roller, the platen moving device and the print head, wherein the control device executes a print processing operation that includes a pull up operation in which the sheet is pulled up, a platen upward movement operation in which the platen roller is moved from the pull up position to the print position, a print and feed operation that synchronizes feeding of the sheet to the sheet ejecting slot with driving of the print head, and a platen downward movement operation in which the platen roller is moved from the print position to the pull up position, and wherein the control device positions the platen roller at an operation start position, which is an intermediate position in a path between the pull up position and the print position, and the control device executes the print processing operation from the operation start position;

a detection device that detects a presence or an absence of the sheet that is pulled up by the platen roller at the operation start position; and an annunciation device that announces that the sheet is not pulled up by the platen roller when the detection device has detected the absence of the sheet before the print processing operation is executed.

2. The sheet bundle printer according to claim 1, further comprising:

a sheet bundle printer body that includes the platen roller, the platen moving device, the print head, and the detection device; and a computer that includes the control device and the annunciation device.

3. A method of controlling a sheet bundle printer, comprising:

pulling up an uppermost sheet out of a sheet bundle by means of a platen roller when the platen roller is located at a pull up position where the platen roller faces the uppermost sheet out of the sheet bundle made up of a multiplicity of sheets releasably adhered together at one end respectively;

moving the platen roller from the pull up position to a print position where the platen roller contacts a print head, and pinching the pulled up sheet between the print head and the platen roller;

feeding the pinched sheet toward a sheet ejecting slot while peeling off the sheet by rotation of the platen roller, performing printing on the sheet, while being fed, by means of the print head;

moving the platen roller from the print position to the pull up position after the print and feed operation is completed;

positioning the platen roller at an operation start position, which is an intermediate position in a path between the pull up position and the print position;

detecting a presence or an absence of the sheet that is pulled up by the platen roller at the operation start position;

announcing that the sheet is not pulled up by the platen roller when the absence of the sheet is detected before the print processing operation is executed; and executing the print processing operation from the operation start position.

* * * * *